US008459784B2

(12) United States Patent
Sumida et al.

(10) Patent No.: US 8,459,784 B2
(45) Date of Patent: Jun. 11, 2013

(54) DISCHARGE LIQUID AGITATING MECHANISM, AND AN INKJET RECORDING APPARATUS HAVING THE DISCHARGE LIQUID AGITATING MECHANISM

(75) Inventors: Ryuhei Sumida, Kyoto (JP); Shiro Kitawaki, Kyoto (JP)

(73) Assignee: Dainippon Screen Mfg. Co., Ltd. (JP)

( * ) Notice: Subject to any disclaimer, the term of this patent is extended or adjusted under 35 U.S.C. 154(b) by 344 days.

(21) Appl. No.: 12/860,430

(22) Filed: Aug. 20, 2010

(65) Prior Publication Data

US 2011/0074893 A1 Mar. 31, 2011

(30) Foreign Application Priority Data

Sep. 25, 2009 (JP) ..... 2009-220518

(51) Int. Cl.
*B41J 2/17* (2006.01)
*B41J 29/38* (2006.01)

(52) U.S. Cl.
USPC ..... 347/84; 347/6

(58) Field of Classification Search
USPC ..... 347/84
See application file for complete search history.

(56) References Cited

U.S. PATENT DOCUMENTS

| | | | | |
|---|---|---|---|---|
| 7,033,005 | B2 * | 4/2006 | Nakamura | 347/85 |
| 2003/0202059 | A1 * | 10/2003 | Kimura et al. | 347/85 |
| 2005/0237368 | A1 * | 10/2005 | Matsumoto | 347/86 |
| 2007/0127901 | A1 * | 6/2007 | Kuzyk | 392/446 |

FOREIGN PATENT DOCUMENTS

| | | |
|---|---|---|
| JP | 2006-327048 | 12/2006 |

* cited by examiner

*Primary Examiner* — Shelby Fidler
(74) *Attorney, Agent, or Firm* — Ostrolenk Faber LLP

(57) ABSTRACT

A discharge liquid agitating mechanism, and an inkjet recording apparatus having the discharge liquid agitating mechanism, are provided which are simple in construction, and are yet capable of preventing sedimentation of particles and the like contained in a discharge liquid.

A discharge liquid agitating mechanism in an inkjet recording apparatus which discharges a discharge liquid to a recording medium while moving the recording medium and inkjet heads 100 relative to each other, includes a main tank 80 formed of a flexible material, a support table 81 for supporting the main tank 80, a nozzle 83 for introducing a compressed gas between the main tank 80 and support table 81, a plurality of subtanks 90 formed of the flexible material, a plurality of plate-like objects 91 for supporting the subtanks 90, nozzles 93 for introducing the compressed gas between the subtanks 90 and plate-like objects 91, a pipeline 86 for connecting the main tank 80 and subtanks 90, and pipelines 96 for connecting the subtanks 90 and inkjet heads 100.

12 Claims, 5 Drawing Sheets

DISCHARGE LIQUID AGITATING MECHANISM, AND AN INKJET RECORDING APPARATUS HAVING THE DISCHARGE LIQUID AGITATING MECHANISM

BACKGROUND OF THE INVENTION

1. Field of the Invention

This invention relates to a discharge liquid agitating mechanism in an inkjet recording apparatus which records images on a recording medium in an inkjet mode, and to an inkjet recording apparatus having the discharge liquid agitating mechanism.

2. Description of the Related Art

In such an inkjet recording apparatus, pigment ink, or UV (Ultraviolet) ink mixed with a curing accelerator or a UV curable resin, is used as a discharge liquid for recording images on a recording medium. The UV ink is cured by being irradiated with ultraviolet light from a UV lamp immediately after the ink is discharged to the recording medium. Therefore, by using such UV ink, it is possible to perform proper printing not only on ordinary paper but also on a film made of a resin which does not absorb ink.

Such UV ink has a problem that pigments acting as a coloring material, metal particles for giving a special gloss and other contained particles settle in the interiors of ink tanks and ink supply routes. An uneven concentration distribution of these particles inside the ink tanks not only causes a reduction in printing accuracy, but can also cause an unsatisfactory discharge performance of inkjet heads when the inkjet recording apparatus is not used for a certain period of time.

Under the circumstances, an inkjet recording apparatus described in Japanese Unexamined Patent Publication No. 2006-327048 has main tanks and subtanks, and uses a pump to circulate ink through pipelines extending between the tanks, thereby to prevent sedimentation of particles and the like contained in the ink.

However, UV curable resin contained in the UV ink, generally, is highly corrosive. Therefore, where the construction described in Japanese Unexamined Patent Publication No. 2006-327048 is employed, it is necessary to use an expensive, corrosion-resistant pump, which poses a problem that the entire apparatus becomes expensive.

SUMMARY OF THE INVENTION

The object of this invention, therefore, is to provide a discharge liquid agitating mechanism, and an inkjet recording apparatus having the discharge liquid agitating mechanism, which are simple in construction, and are yet capable of preventing sedimentation of particles and the like contained in a discharge liquid, without circulating the discharge liquid.

The above object is fulfilled, according to this invention, by a discharge liquid agitating mechanism in an inkjet recording apparatus which discharges a discharge liquid to a recording medium while moving the recording medium and inkjet heads relative to each other, comprising a flexible discharge liquid container; a support member for supporting the discharge liquid container; and a gas supply device for introducing a compressed gas between the discharge liquid container and the support member; wherein currents of the compressed gas supplied from the gas supply device vibrate the discharge liquid container to agitate the discharge liquid.

With such discharge liquid agitating mechanism, currents of the compressed gas supplied from the gas supply device vibrate the discharge liquid container. Consequently, although simple in construction, the discharge liquid stored in the container can be agitated.

In a preferred embodiment, the discharge liquid agitating mechanism supplies the compressed gas intermittently when discharge of the discharge liquid from the inkjet heads is stopped. This can prevent the vibration of the discharge liquid container, when supplying the compressed gas, from influencing the inkjet heads, thereby to maintain high printing accuracy.

In another aspect of this invention, a discharge liquid agitating mechanism in an inkjet recording apparatus which discharges a discharge liquid to a recording medium while moving the recording medium and inkjet heads relative to each other, comprises a main tank formed of a flexible material; a first support member for supporting the main tank; a first gas supply device for introducing a compressed gas between the main tank and the first support member; a plurality of subtanks formed of the flexible material; a plurality of second support members for supporting the subtanks; a second gas supply device for introducing the compressed gas between the subtanks and the second support members; a first pipeline for connecting the main tank and the subtanks; and second pipelines for connecting the subtanks and the inkjet heads; wherein, by supplying the compressed gas to the main tank and the subtanks, respectively, the first gas supply device and the second gas supply device are arranged to vibrate the main tank and the subtanks, respectively, to agitate the discharge liquid.

With such discharge liquid agitating mechanism, since the main tank and subtanks are provided, liquid volume variations in the main tank impart little influence, to maintain the discharge constant. It is also possible to change the main tank, thereby allowing the discharge liquid to be replenished cleanly and easily.

In a further aspect of this invention, there is provided an inkjet recording apparatus which discharges a discharge liquid to a recording medium while moving the recording medium and inkjet heads relative to each other, comprising a discharge liquid agitating mechanism, the discharge liquid agitating mechanism including a flexible discharge liquid container; a support member for supporting the discharge liquid container; and a gas supply device for introducing a compressed gas between the discharge liquid container and the support member; wherein currents of the compressed gas supplied from the gas supply device vibrate the discharge liquid container to agitate the discharge liquid.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
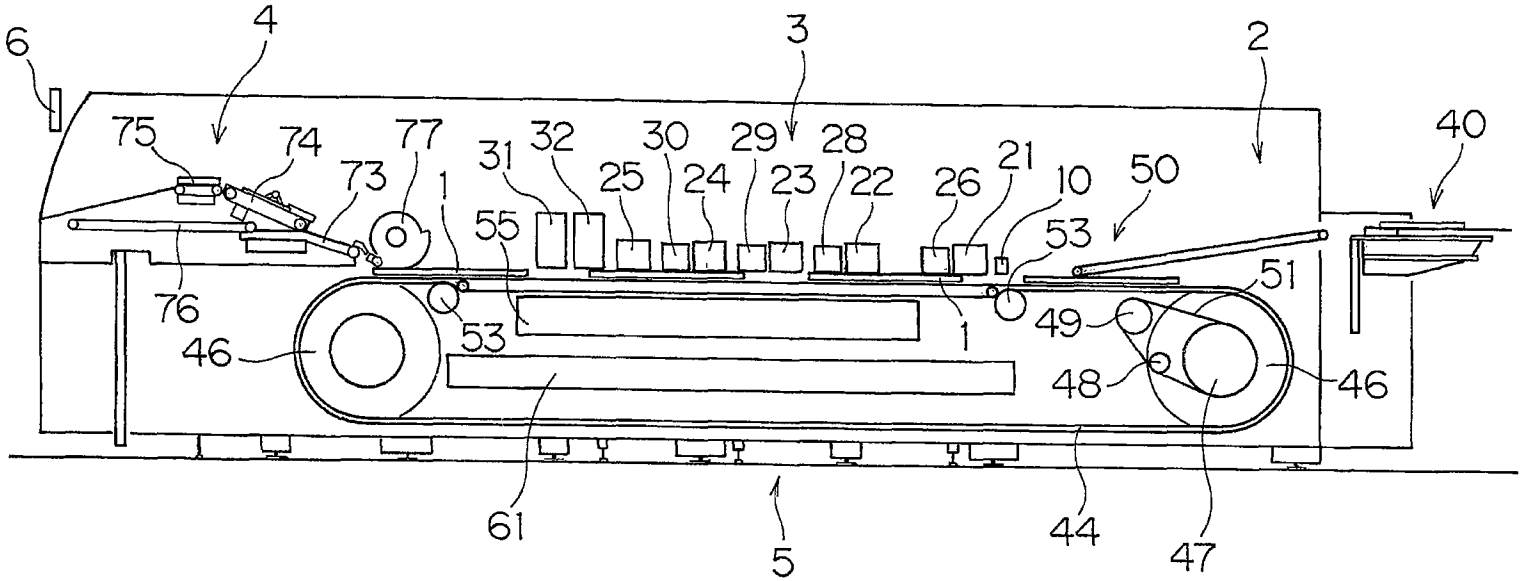
FIG. 1 is a schematic side view of an inkjet recording apparatus according to this invention.

An embodiment of this invention will be described hereinafter with reference to the drawings. The construction of an inkjet recording apparatus according to this invention will be described first. FIG. 1 is a schematic side view of the image recording apparatus according to this invention.

The inkjet recording apparatus is constructed to record images on printing paper serving as a recording medium held on tables 1 by suction. The apparatus includes a paper feeder 2, a paper discharger 4, a table moving mechanism 5 for moving ten tables 1 arranged at regular intervals along a circulating track, an image recorder 3 for recording images on the printing paper on the tables 1 moved by the table moving mechanism 5, a GUI (Graphical User Interface) 6 having a touch-panel input and output unit, and a temperature sensor 10 for measuring the surface temperature of tables 1 in movement.

The paper feeder 2 includes a stocker unit 40 and a feed section 50. The stocker unit 40 holds the printing paper on an upper portion thereof, and feeds the printing paper, one sheet at a time, to the feed section 50. The feed section 50 feeds the printing paper received from the stocker unit 40 to the tables 1 moving along the circulating track.

The image recorder 3 records images in an inkjet mode on the printing paper held by suction on the upper surfaces of tables 1 moved in one direction by the table moving mechanism 5. This image recorder 3 includes a pretreatment agent coating head 21, four recording heads 22, 23, 24 and 25, five heaters 26, 28, 29, 30 and 31, and a scanner 32. A discharge liquid agitating mechanism to be described hereinafter is disposed in this image recorder 3.

The pretreatment agent coating head 21 applies a transparent pretreatment agent to the printing paper before the four recording heads 22, 23, 24 and 25 record images. As this pretreatment agent, an anchor coat is used for improving adhesion of ink to the printing paper when, for example, glossy printing paper or grazed printing paper is used.

The four recording heads consist of a recording head 22 for black ink, a recording head 23 for cyan ink, a recording head 24 for magenta ink, and a recording head 25 for yellow ink. The recording heads 22, 23, 24 and 25 are arranged above the tables 1 movable in one direction. Each of these recording heads 22, 23, 24 and 25 includes a plurality of inkjet heads having numerous inkjet nozzles arranged in a direction perpendicular to the moving direction of the tables 1, and discharge the inks from the inkjet nozzles onto the printing paper to record images thereon.

The five heaters consist of a preheating heater 26, intermediate heaters 28, 29 and 30, and a main heater 31. These heaters 26, 28, 29, 30 and 31 are constructed to blow hot air to the printing paper. The scanner 32 has a linear CCD camera for measuring the density of entire images and/or patches recorded.

A suction fan 55 is disposed under the moving track of tables 1. The tables 1 have a hollow structure, and have suction bores formed in the surfaces thereof to communicate with the inner spaces. Thus, by exhausting air from the suction fan 55, the printing paper supplied to the surfaces of tables 1 are held on the tables 1 by suction through the suction bores.

The paper discharger 4 includes a paper discharge cylinder 77 for wrapping the printing paper peripherally thereof to separate the printing paper from each table 1. This paper discharger 4 is constructed for switching transport of the printing paper received from the paper discharge cylinder 77 between two directions, one through a transport path provided by a first conveyor 73 and a second conveyor 76, and the other through a transport path provided by a third conveyor 74 and a fourth conveyor 75.

Figure 2:
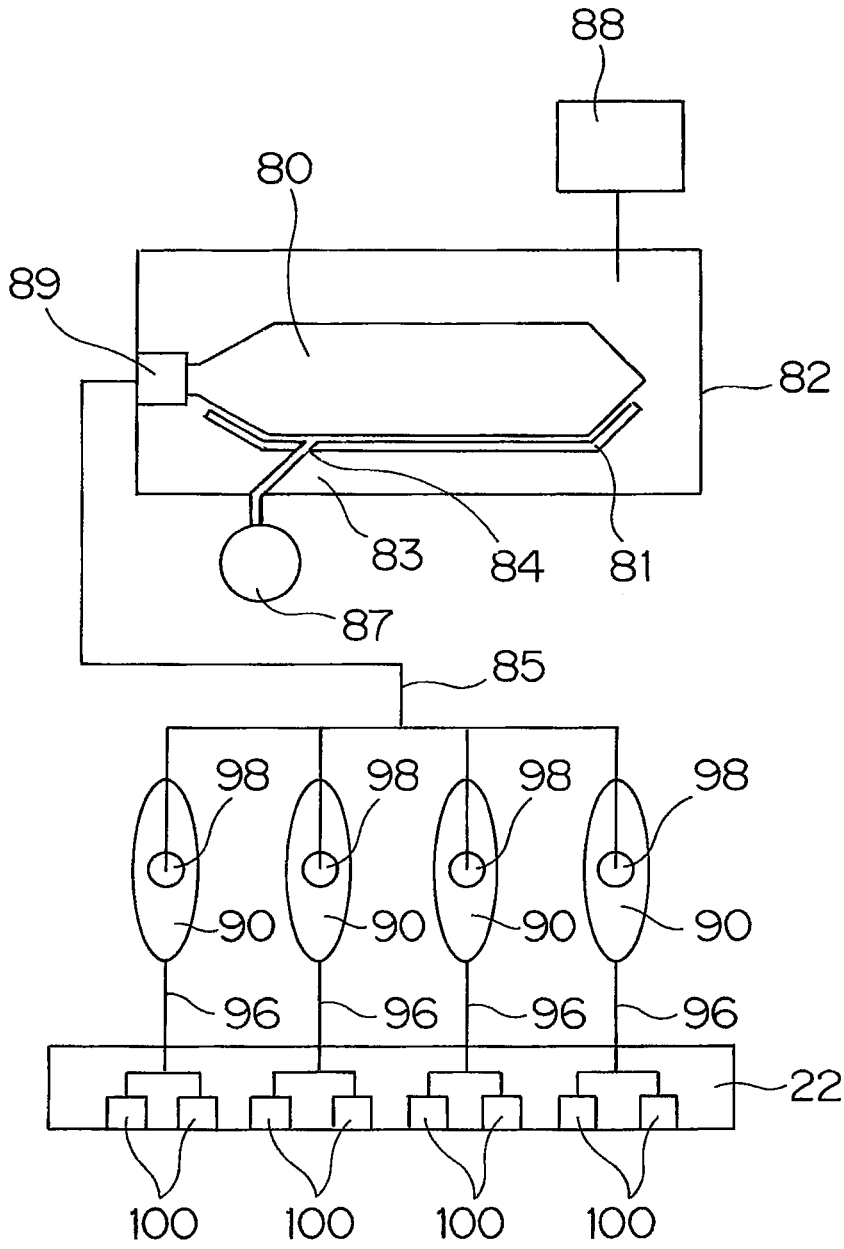
FIG. 2 is an explanatory view illustrating an outline of a discharge liquid agitating mechanism.

Next, the discharge liquid agitating mechanism will be described. FIG. 2 is an explanatory view illustrating an outline of the discharge liquid agitating mechanism.

This discharge liquid agitating mechanism includes, as discharge liquid containers, a bag-like main tank 80 formed of a flexible material, and four bag-like subtanks 90 also formed of the flexible material. The main tank 80 and subtanks 90 are arranged above each of the pretreatment agent coating head 21 and four recording heads 22, 23, 24 and 25 of the image recorder 3 shown in FIG. 1. FIG. 2 shows, by way of example, the discharge liquid agitating mechanism disposed above the recording head 22 which has eight inkjet heads 100.

The main tank 80 is placed on a support table 81 which is substantially horizontal, and their entirety is housed in a casing 82. The support table 81 has a bore 84 formed in a bottom surface thereof, where a nozzle 83 acting as a compressed gas supply device is connected for blowing in compressed air acting as a compressed gas. A compressor 87 is connected to the nozzle 83 for delivering the compressed air. A pressurization adjusting unit 88 is connected to the casing 82 for adjusting pressure in the casing 82 to a predetermined pressure in order to feed the ink from the main tank 80 to the subtanks 90. Pressure piping of plant facilities may be branched for use with these compressor 87 and pressurization adjusting unit 88.

The subtanks 90 have a smaller capacity than the main tank 80. In this embodiment, four subtanks 90 with a capacity of about 100 ml are provided for one main tank 80 with a capacity of about 2 to 3 L. The four subtanks 90 are connected to the main tank 80 through a pipeline 85. The ink is fed from the four subtanks 90 to the inkjet heads 100 in the recording head 22 through pipelines 96, respectively.

The main tank 80 and subtanks 90, which are bag-like containers formed of a flexible material, are deformable with variations in the quantity of the pretreating agent or ink stored therein. If the discharge liquid containers were not deformable, layers of air would be formed in the discharge liquid containers, and variations in the internal pressure due to a reduction in the quantity of the pretreating agent or ink stored therein would cause a phenomenon of air flowing back from the inkjet nozzles, thereby causing an unsatisfactory discharge performance of the inkjet nozzles. Therefore, the main tank 80 and subtanks 90 are formed of a flexible material, to be deformable in liquid-tight state in response to internal liquid quantity, thereby preventing the unsatisfactory discharge performance of the inkjet nozzles due to the air in the main tank 80 and subtanks 90.

Figure 3A:
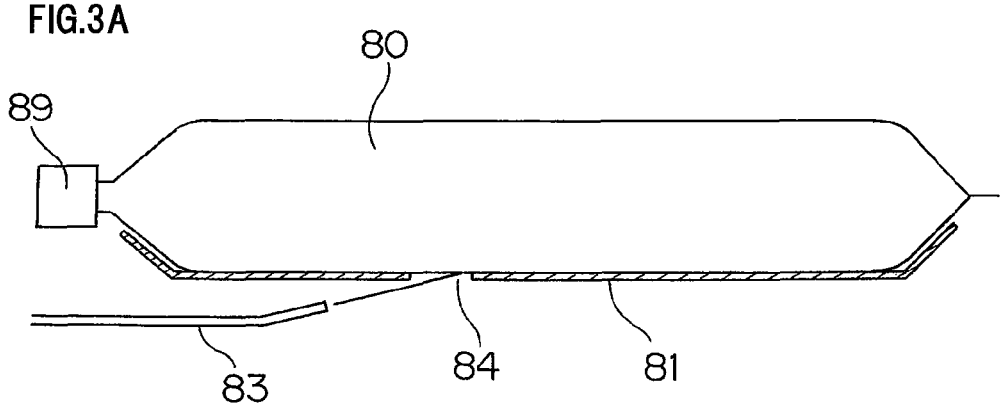
FIG. 3A is an explanatory view illustrating a state of feeding compressed air to a main tank 80.
Figure 3B:
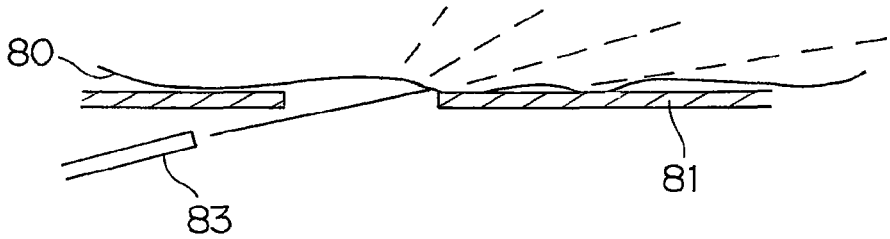
FIG. 3B is an explanatory view illustrating a state of feeding compressed air to the main tank 80.

FIGS. 3A and 3B are explanatory views illustrating a state of directing compressed air to the main tank 80. FIG. 3A shows how the compressed air is blown to the main tank 80. FIG. 3B shows in enlargement how the compressed air is blown to the main tank 80.

The main tank 80 is placed on the support table 81 to have an ink outlet port 89 facing sideways. With the main tank 80 placed in this way, a large area of contact between the bag-shaped external surface of the main tank 80 and the upper surface of the support table 81 can be secured. The support table 81 has the bore 84 formed in a position close to the ink outlet port 89 of the main tank 80. As shown in FIG. 3A, through this bore 84 the nozzle 83 blows compressed air from obliquely below the support table 81 to the main tank 80, to form air currents flowing in one direction away from the outlet port 89 of the main tank 80. When the compressed air is blown to the main tank 80, a gap between the main tank 80 and support table 81 is decompressed, whereby the flexible main tank 80 temporarily sticks to the upper surface of the support table 81. When the compressed air is further blown thereafter, as shown in FIG. 3B, the external surface of the flexible main tank 80 will vibrate slightly in an undulating manner. By vibrating the main tank 80 in this way, the discharge liquid in the main tank 80 can be agitated uniformly.

In order to vibrate the main tank 80 and agitate the discharge liquid effectively, the bore 84 of the support table 81 and the nozzle 83 need to be arranged in such a positional relationship that currents of the compressed air are formed between the support table 81 and main tank 80, to flow in one direction which is the longitudinal direction of the main tank 80. It is therefore preferred that the position of the bore 84 in the support table 81 is close to the outlet port 89, and a bore may be formed in a side plate of the support table 81 located under the outlet port 89.

Figure 4A:
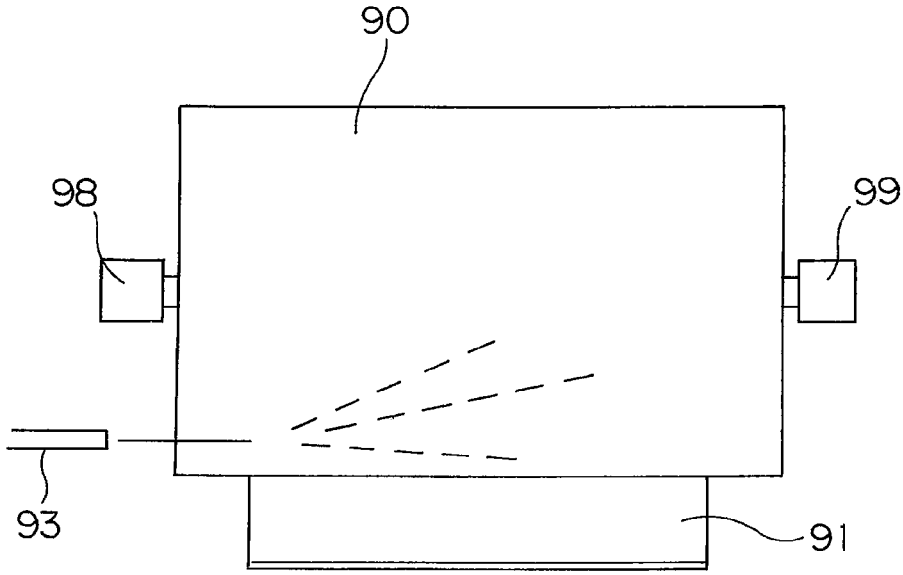
FIG. 4A is an explanatory view illustrating a state of feeding compressed air to a subtank 90.
Figure 4B:
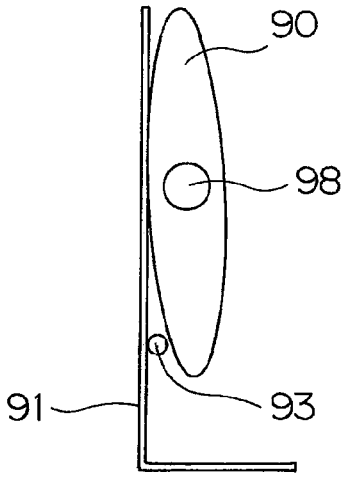
FIG. 4B is an explanatory view illustrating a state of feeding compressed air to the subtank 90.

FIGS. 4A and 4B are explanatory views illustrating a state of directing compressed air to each subtank 90. FIG. 4A is a front view of the subtank 90 and adjacent components. FIG. 4B is a side view of the subtank 90 and adjacent components.

Each subtank 90 has an inlet port 98 for receiving the ink flowing through the pipeline 85 from the main tank 80, and an outlet port 99 for discharging the ink to the pipeline 96 connecting the subtank 90 and inkjet heads 100. The subtank 90 is stuck to a plate-like object 91 acting as support member extending substantially vertically, to have the inlet port 98 and outlet port 99 facing sideways. As shown in FIG. 4B, the plate-like object 91 is L-shaped in a side view. The subtank 90 is partially stuck to the plate-like object 91 using double-stick tape, so as to form a gap between the subtank 90 and plate-like object 91 where the compressed air from a nozzle 93 can flow in. Although not shown in FIG. 2, the nozzles 93 constituting the compressed gas supply device for supplying compressed air to the subtanks 90 are connected to the compressor 87 as is the nozzle 83 noted above.

As shown in FIGS. 4A and 4B, the nozzle 93 directs the compressed air to the subtank 90, to form horizontal gas currents flowing from a lateral position toward a gap between a portion of the plate-like object 91 located below the subtank 90 and an external surface of the subtank 90. Consequently, the subtank 90 vibrates in the same way as the main tank 80 described above, to agitate the discharge liquid in the subtank 90 uniformly.

Figure 5:
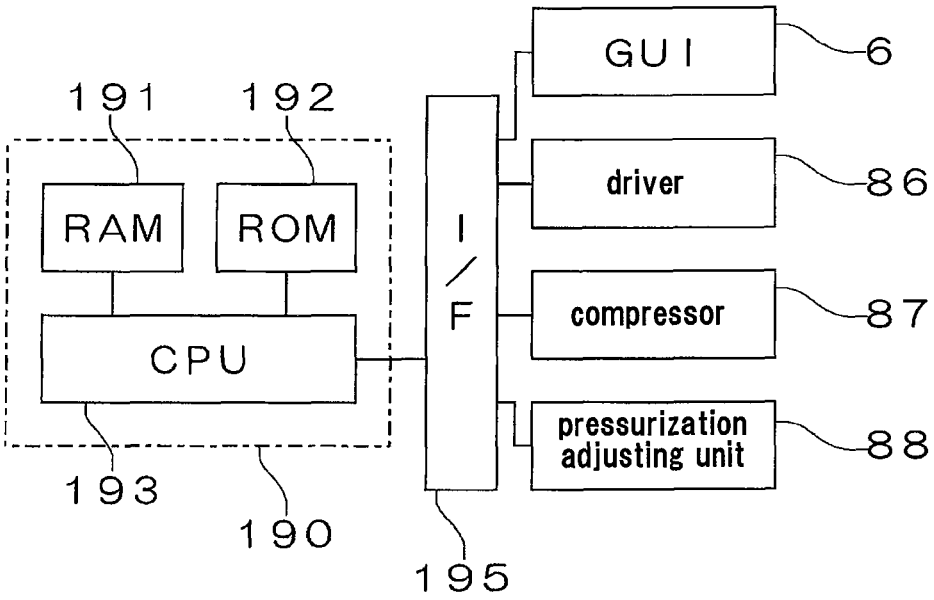
FIG. 5 is a block diagram showing a principal electrical structure of the inkjet recording apparatus according to this invention.

FIG. 5 is a block diagram showing a principal electrical structure of the above inkjet recording apparatus. This inkjet recording apparatus includes a controller 190 having a RAM 191 for temporarily storing data and the like at times of control, a ROM 192 for storing operating programs required for control of the apparatus, and a CPU 193 for performing logical operations. This controller 190 is connected through an interface 195 to the GUI 6 noted hereinbefore and to a driver 86 for driving various components of the inkjet recording apparatus. The controller 190 is connected also to the compressor 87 and pressurization adjusting unit 88 noted hereinbefore. This controller 190 controls various types of operation of the inkjet recording apparatus.

In the inkjet recording apparatus having the above construction, the supply of compressed air from the compressor 87 is stopped at normal image recording times. In this state, while the tables 1 holding the printing paper by suction are moved along the circulating track, the inks are discharged from the inkjet nozzles by the action of piezoelectric elements arranged in the inkjet heads.

The interior of the casing 82 in which the main tank 80 is mounted is pressurized to a fixed pressure (0.02 MPa in this embodiment) by the pressurization adjusting unit 88. At this time, the discharge liquid is continuously fed from the main tank 80 to the subtanks 90 in this inkjet recording apparatus, to maintain the discharge liquid volume in the subtanks 90 at about 50 to 70% of the capacity of the subtanks 90.

Compressed air is supplied from the nozzles 83 and 93 to the main tank 80 and subtanks 90 when an image recording is not carried out, such as when preparations are made for an image recording or when an image recording is suspended. That is, the compressor 87 is driven when the discharge liquid is not discharged from the inkjet heads 100. Compressed air is supplied to the main tank 80 and subtanks 90 when an image recording is not carried out as noted above, in order to prevent a situation where imaging accuracy is impaired by the vibrations applied to the main tank 80 and subtanks 90 and transmitted to the recording heads 22, 23, 24 and 25.

Where the discharge liquid is a common water-soluble pigment ink, the compressed air may be supplied to the main tank 80 and subtanks 90 intermittently at a frequency of about once every hour. In this case, the time for supplying the compressed air may be about 10 seconds for compressed air of about 0.5 MPa used in factory piping, which can fully agitate the discharge liquid and maintain uniformity of the discharge liquid.

Therefore, this inkjet recording apparatus controls the driving of the compressor 87 to supply the compressed air to the main tank 80 and subtanks 90 intermittently when the discharge liquid is not discharged from the inkjet heads 100.

When compressed air piping which is part of plant facilities is branched for use as a source of compressed air, instead of the compressor 87, a switch valve mounted on the piping may be controlled to adjust the supply time, supply intervals and supply timing of compressed air to the main tank 80 and subtanks 90.

In this inkjet recording apparatus, the supply time, supply intervals and supply timing of compressed air can also be varied as appropriate according to the behavior of the discharge liquid used for image recording. The supply of compressed air may be carried out manually, instead of relying on a recording apparatus operating program stored in the ROM 192 of the controller 190.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2009-220518 filed in the Japanese Patent Office on Sep. 25, 2009, the entire disclosure of which is incorporated herein by reference.

What is claimed is:

1. A discharge liquid agitating mechanism in an inkjet recording apparatus which discharges a discharge liquid to a recording medium while moving the recording medium and inkjet heads relative to each other, comprising:

a flexible discharge liquid container;

a support member for supporting the discharge liquid container; and a gas supply device for introducing a compressed gas between the discharge liquid container and the support member in order to form air currents flowing in one direction along a longitudinal direction of the discharge liquid container;

wherein the air currents of the compressed gas supplied from the gas supply device change a pressure occurring between the discharge liquid container and the support member and vibrate the discharge liquid container to agitate the discharge liquid.

2. The discharge liquid agitating mechanism according to claim 1, wherein the gas supply device is arranged to supply the compressed gas to the discharge liquid container intermittently when discharge of the discharge liquid from the inkjet heads is stopped.

3. The discharge liquid agitating mechanism according to claim 1, wherein the gas supply device has a nozzle and blows the compressed gas from the nozzle to a gap between the discharge liquid container and the support member in order to form air currents flowing in one direction being the longitudinal direction of the discharge liquid container.

4. A discharge liquid agitating mechanism in an inkjet recording apparatus which discharges a discharge liquid to a recording medium while moving the recording medium and inkjet heads relative to each other; comprising:

a main tank formed of a flexible material;

a first support member for supporting the main tank;

a first gas supply device for introducing a compressed gas between the main tank and the first support member in order to form air currents flowing in one direction along a longitudinal direction of the main tank;

a plurality of subtranks formed of the flexible material;

a plurality of second support members for supporting the subtanks;

a second gas supply device for introducing the compressed gas between the subtanks and the second support members in order to form air currents flowing in one direction along longitudinal directions of the subtanks.

a first pipeline for connecting the main tank and the subtanks; and second pipelines for connecting the subtanks and the inkjet heads;

wherein, by supplying the compressed gas to the main tank and the subtanks, respectively, the first gas supply device and the second gas supply device are arranged to change a pressure occurring between the main tank and the subtanks, respectively, and the corresponding support members, and to agitate the discharge liquid.

5. The discharge liquid agitating mechanism according to claim 4, wherein the first gas supply device and the second gas supply device are arranged to supply the compressed gas to the main tank and the subtanks intermittently when discharge of the discharge liquid from the inkjet heads is stopped.

6. The discharge liquid agitating mechanism according to claim 4, wherein the first support member is a support table extending substantially horizontally, the main tank being placed on the support table.

7. The discharge liquid agitating mechanism according to claim 4, wherein the second support members are plate-like objects extending substantially vertically, the subtanks being stuck to the plate-like objects.

8. The discharge liquid agitating mechanism according to claim 4, wherein each gas supply device has a nozzle and blows the compressed gas from the nozzle to a gap between the respective main tank or subtank and the corresponding support member in order to form air currents flowing in one direction along a longitudinal direction of the corresponding main tank or subtank.

9. An inkjet recording apparatus which discharges a discharge liquid to a recording medium while moving the recording medium and inkjet heads relative to each other;

comprising a discharge liquid agitating mechanism, the discharge liquid agitating mechanism including:

a flexible discharge liquid container;

a support member for supporting the discharge liquid container; and a gas supply device for introducing a compressed gas between the discharge liquid container and the support member in order to form air currents flowing in one direction along a longitudinal direction of the discharge liquid container;

wherein the air currents of the compressed gas supplied from the gas supply device change a pressure occurring between the discharge liquid container and the support member and vibrate the discharge liquid container to agitate the discharge liquid.

10. The discharge liquid agitating mechanism according to claim 9, wherein the gas supply device has a nozzle and blows the compressed gas from the nozzle to a gap between the discharge liquid container and the support member in order to form air currents flowing in one direction being the longitudinal direction of the discharge liquid container.

11. An inkjet recording apparatus which discharges a discharge liquid to a recording medium while moving the recording medium and inkjet heads relative to each other; comprising a discharge liquid agitating mechanism, the discharge liquid agitating mechanism including:

a main tank formed of a flexible material;

a first support member for supporting the main tank;

a first gas supply device for introducing a compressed gas between the main tank and the first support member in order to form air currents flowing in one direction along a longitudinal direction of the main tank;

a plurality of subtanks formed of the flexible material;

a plurality of second support members for supporting the subtanks;

a second gas supply device for introducing the compressed gas between the subtanks and the second support members in order to form air currents flowing in one direction along longitudinal directions of the subtanks;

a first pipeline for connecting the main tank and the subtanks; and second pipelines for connecting the subtanks and the inkjet heads;

wherein, by supplying the compressed gas to the main tank and the subtanks, respectively, the first gas supply device and the second gas supply device are arranged to change a pressure occurring between the main tank and the subtanks, respectively, and the corresponding support members, and to agitate the discharge liquid.

12. The discharge liquid agitating mechanism according to claim 11, wherein each gas supply device has a nozzle and blows the compressed gas from the nozzle to a gap between the respective main tank or subtank and the corresponding support member in order to form air currents flowing in one direction along a longitudinal direction of the corresponding main tank or subtank.

* * * * *